United States Patent [19]

Leleu

[11] 4,281,707

[45] Aug. 4, 1981

[54] CENTRIFUGAL CASTING MACHINE, EQUIPPED WITH MEANS FOR STRIPPING AND AUTOMATIC RELEASE OF THE RESULTING CASTINGS

[75] Inventor: Jean Leleu, Acheres, France

[73] Assignee: Etablissements A. Voisin, Puteaux, France

[21] Appl. No.: 147,160

[22] Filed: May 6, 1980

[30] Foreign Application Priority Data

Dec. 20, 1979 [FR] France ..... 79 31325

[51] Int. Cl.[3] ..... B22D 13/04

[52] U.S. Cl. ..... 164/292; 164/295; 425/441

[58] Field of Search ..... 164/114, 292, 295, 342–344; 249/56, 162; 425/330, 441, 425

[56] References Cited

U.S. PATENT DOCUMENTS 2,923,986 2/1960 Ross ..... 164/292

FOREIGN PATENT DOCUMENTS 617986 11/1926 France ..... 249/162

2222160 10/1974 France ..... 164/114

*Primary Examiner*—Robert D. Baldwin

*Attorney, Agent, or Firm*—Shenier & O'Connor

[57] ABSTRACT

The invention relates to a centrifugal casting machine, comprising on a base stand, a rotating assembly consisting of a mold, a bracket for stripping and releasing the casting. After solidification, the mold is opened by means of a plate movable vertically of the assembly and the upper part of the mold is gripped and transferred by the bracket straight above a position where the casting attached thereto is released. The mold is then closed again and rotated for the next casting.

10 Claims, 6 Drawing Figures

Figure 1:
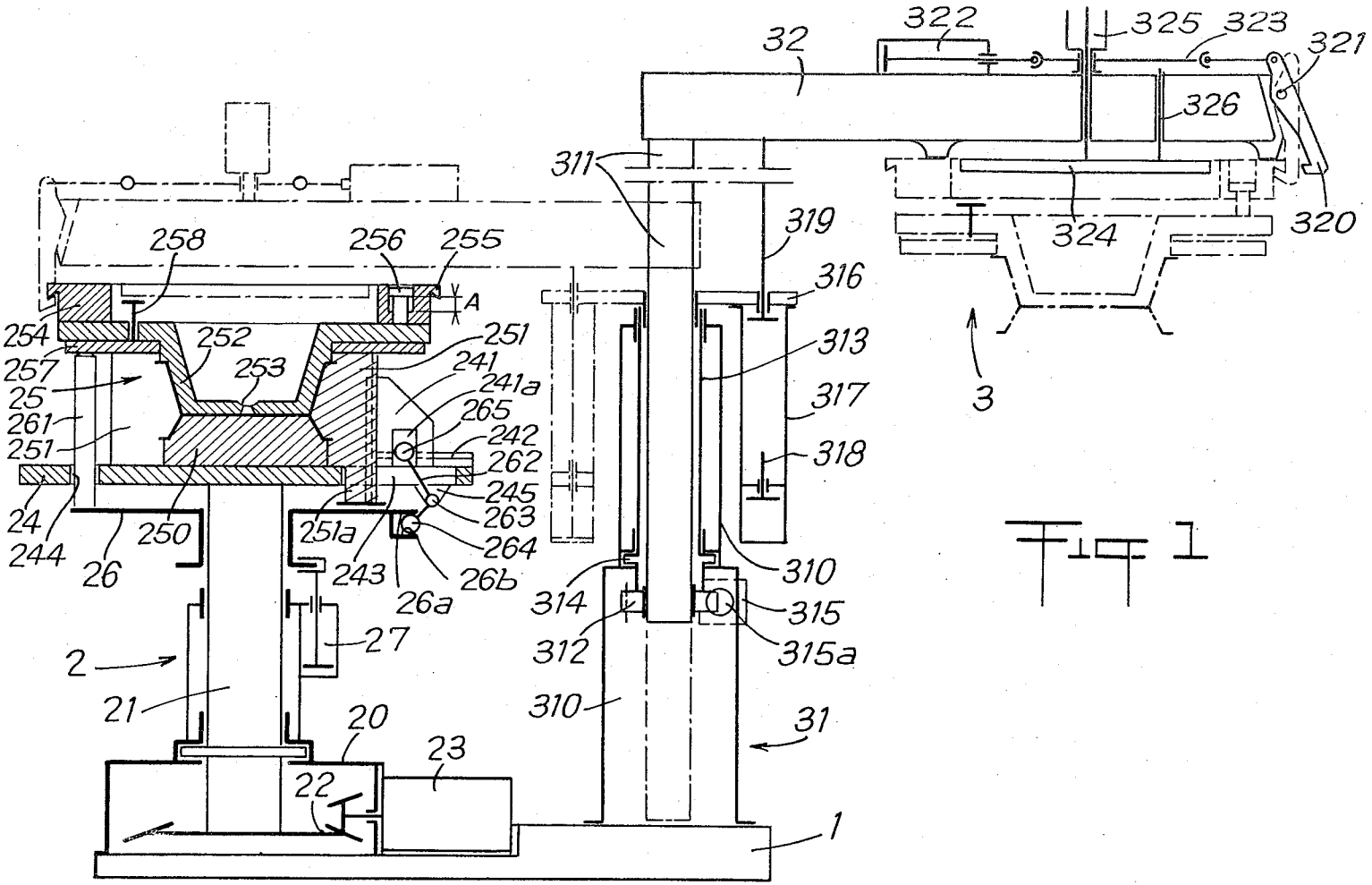

32
323
325
326
321
320
324
255
258
256
254
259
257
251
25
252
253
241
265
251
241a
243
245
24
250
262
244
251a
263
261
264
26
26b
26a
21

251
261
252
4
241
243
24
265
26
264
262
263

251
261

261
251
251
261

CENTRIFUGAL CASTING MACHINE, EQUIPPED WITH MEANS FOR STRIPPING AND AUTOMATIC RELEASE OF THE RESULTING CASTINGS

The present invention relates to a centrifugal casting machine for producing castings in light alloys such as for example a motorcar wheel.

Centrifugal casting is a known method. The invention is more particularly directed to a machine permitting to automate this type of production, i.e. to eliminate any manual intervention for stripping the castings after solidification and for reconstituting and closing the mold to receive the next casting.

The object of the invention is to propose to this effect a centrifugal casting machine, for producing light alloy castings such as for example a vehicle wheel, comprising a mold made up of several parts, and fast with a support pivoting about a vertical axis, means for closing and opening the mold and means for stripping the casting.

According to one of the characteristics of the invention, the said mold is composed of a base plate integral with the said support, of lateral parts and of an upper part provided, in the vertical axis of the support, with a mold supplying orifice, the said opening and closing means are constituted by a plate, which is movable vertically along the pivoting support, and comprising pins for lifting the said upper part, being supported under a lower face of the latter, and a connecting rod assembly connecting the said lateral parts to the said plate so as to drive the latter radially when the plate moves axially, whereas the said stripping means are constituted by a bracket formed by a vertical post and by a horizontal arm rotatably and vertically movable with respect to the post, said arm being equipped with means for gripping the upper part of the mold and for stripping the casting.

In a preferred embodiment of the invention, each lateral part of the mold is coupled, for vertical sliding, with an outer shoe for radial driving, which is adapted to slide radially on the pivoting support and comprises a lower part extending through the said support on which lower part, the plate which is mounted for vertical movement along the support, can rest during its vertical movement for raising the said lateral wall at the same time as the upper part of the mold.

The said connecting rod assembly consists of a radial lever bent at an angle of about 90°, pivotally mounted by its top end on the said pivoting support, one of its other ends being engaged between two horizontal faces of the said vertically movable plate, whereas the other end is engaged between two vertical faces of the said shoe.

In addition, the upper part of the said mold comprises an upper frame provided with an external gripping ring, which frame is coupled to the rest of the said upper part by means which permit a vertical movement of the frame, with respect to the said part of the mold and above it, of a predetermined amplitude.

Moreover, the upper part of the said mold comprises a stripping plate placed under the lower face of the said upper part and coupled thereto by means which permit a relative vertical movement of the said plate, beneath the said surface, of a predetermined amplitude, when said means are actuated by an ejector device.

In this embodiment, the horizontal arm of the bracket is integral with a vertical column mounted for rotation and translation in a vertical support parallel to the aforesaid pivoting support, the said arm being provided with hinged claws adapted to cooperate with the gripping ring of the said frame, under the effect of a member for controlling the pivoting movement of the said claws.

Finally, the aforesaid horizontal arm is provided with an ejection plate coupled with a member for controlling its vertical movement under the said arm, and adapted to cooperate inside the frame with the coupling means of the stripping plate.

The invention will be better understood on reading the following description with reference to the accompanying drawings, in which:

FIG. 1 is a diagrammatical view of the device according to the invention; and FIGS. 2, 3, 4, 4A and 5 cross-sectionally illustrate how the device according to the invention works as far as the constitution of the mold and the stripping of the casting are concerned.

Referring first to FIG. 1, this shows two assemblies 1 and 2 which constitute the machine according to the invention and rest on a base stand 1. The assembly 2 is essentially composed of a fixed bed-plate 20 inside which a vertical shaft 21 is mounted for rotation. Said shaft 21 is moved in rotation by means of a cone-shaped angular member 22, in input shaft of which is connected to a motor 23. At the top part of the shaft 21, there extends a supporting plate 24, which supports all the elements constituting a mold 25. A second plate 26 situated under the plate 24 is adapted to be moved vertically along the shaft 21 by means of a hydraulic jack 27 coupled between the bed-plate 20 and the plate 26 proper. Said plates 25 and 26 pivot with the shaft 21.

The mold 25 is composed of a sill 250 integral with the pivoting support (shaft 21 and plate 24) by its lateral parts 251 and by its upper part 252, provided with a central orifice 253 situated straight above the vertical axis of rotation of the shaft 21 for pouring the molten metal into the mold. A frame 254 is situated above the said part 252 and is provided with an outer ring 255 for gripping by means of claws described hereinafter. The frame is coupled with the part 252 of the mold by means of tie-bolts 256 which permit a vertical upwards movement of the frame with respect to the part 252 of predetermined amplitude A. A so-called "stripping" plate 257 is placed under a lower face of the part 252 and is secured to the latter by tie-bolts 258 which permit a vertical downwards movement of the plate 257 with respect to the part 252, in order, as will be seen hereinafter, to come into contact with the casting to be stripped and to release it from the said part 252.

Said FIG. 1 does not show the means provided for centering and assembling these various parts of the mold. Such means will be seen in FIGS. 2 to 5 which show an industrial embodiment of this mold. Each one of the lateral parts 251 (which can be three in number for example) is mounted for vertical sliding on a shoe 241, which shoe is adapted to slide radially in a (radial) guiding groove 242 provided in the upper face of the plate 24. Moreover, each lateral part 251 comprises a lower extension **251*a* which goes through the plate 24 via an opening 243 in order to constitute a part on which the upper face of the plate 26** can rest during its vertical upwards motion.

The plate 26 comprises spindles or posts (261) (three for example) traversing the plate 24 through openings 244, so as to come into contact with the lower surface of the upper part 252 of the mold, or to be more precise, with the lower face of the stripping plate 257.

Finally, a radial lever 262, bent to form an angle of about 90°, is pivotally mounted in 263 by its top end on an extension 245 of the plate 24. One of its ends 264 is housed between two parallel surfaces 26*a* and 26*b* of the plate 26, whilst its other end 265 is situated so as to cooperate with the two edges of a notch 241*a* of the shoe 241. Thus, the vertical movements of the plate 26 are transmitted, via the lever 262, as horizontal movements, to the shoe 241. It will be noted, first, that its inclination is selected so that the arc of circle described by the end 264 is the one near its vertical tangent and that the arc of circle described by the end 265 is the one near its horizontal tangent.

As to assembly 3, this is constituted by a bracket comprising a column 31 and a horizontal arm 32. The column 31 comprises a fixed body 310 integral with the base stand 1 in which a shaft 311 is adapted to pivot and slide vertically. The rotation of the vertical shaft 311 is ensured by a pinion 312 fast in rotation with the said shaft, but free in translation with respect thereto and integral with a pivoting sleeve 313 which is immobilized in translation on the body 310 by a bearing 314. Said pinion 312 cooperates with the rack-shaped rod 315*a* of a hydraulic jack 315 integral with the body. The translational guiding of the shaft 311 is ensured by bearings supported by the sleeve 313.

Said sleeve is provided at its upper part with a radial extension 316 on which is connected the body of a double-acting hydraulic jack 317, which comprises a first piston rod 318, and a second rod 319, coupled to the arm 32. Thus, when the shaft 311 is entirely retracted inside the framework 31, the rod 318 is in its low position, as well as the rod 319 which comes into abutment on the end of the rod 318. A vertical raising of the rod 318 causes an upwards sliding of the shaft 311 of a predetermined amplitude which corresponds to the raising amplitude A of the frame 254 with respect to the mold. Then by drawing out of the mold the rod 319, the arm 32 is raised of an amplitude at least equal to that necessary to place the upper part of the mold and the casting that it carries above the top of the spindles 261 in their maximum elevation position at the end of opening operation of the mold, so that the the arm can be rotated about the vertical axis of the column.

The arm 32 is provided with a plurality of claws 320 (only one of which is shown in the figure) which are mounted for pivoting about a horizontal axis 321. The top part of said claws is connected to a corresponding jack 322 via a linkage system 323 of which the supply in pressurized fluid or its release causes the pivoting movement of said claw between a close-to position shown in broken lines, wherein it cooperates with the ring 255 of the frame 254, and a remote position wherein it is not meshing in with the said ring.

Finally, the arm 32 comprises a horizontal ejector plate 324 with external dimensions which allow it to slide inside the frame 254, which ejector plate is coupled to the vertical rod of a hydraulic jack 325 and is placed substantially in the vertical axis of the shaft 21 when the arm 32 is placed straight above it. Small columns 326 ensure the guiding of the plate 324 with respect to the arm 32.

Figure 2:
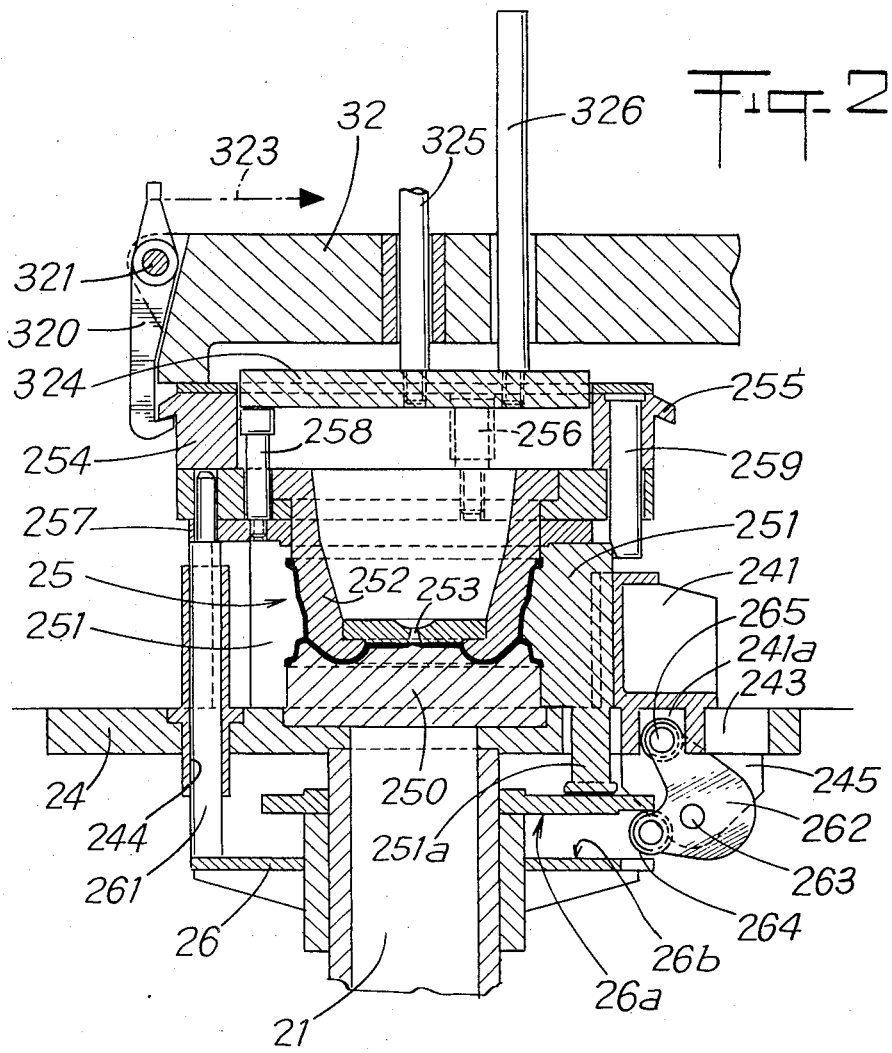

FIG. 2 shows the mold according to the invention after a casting operation and cooling of the casting. Some of the elements described hereinabove are shown with the same references. It will be noted on that Figure that the frame 254 has elements 259 which cooperate to centering the upper part 252 of the mold with respect to its lateral parts 251.

Said Figure shows that the arm 32 has been brought above and in contact with the mold 25, by rotating (jack 315) and bringing down (double-acting jack 317) the shaft 311, the clamps being apart, then the jacks 322 are fed in order to tighten the clamps on the ring 255 of the frame 254.

Figure 3:
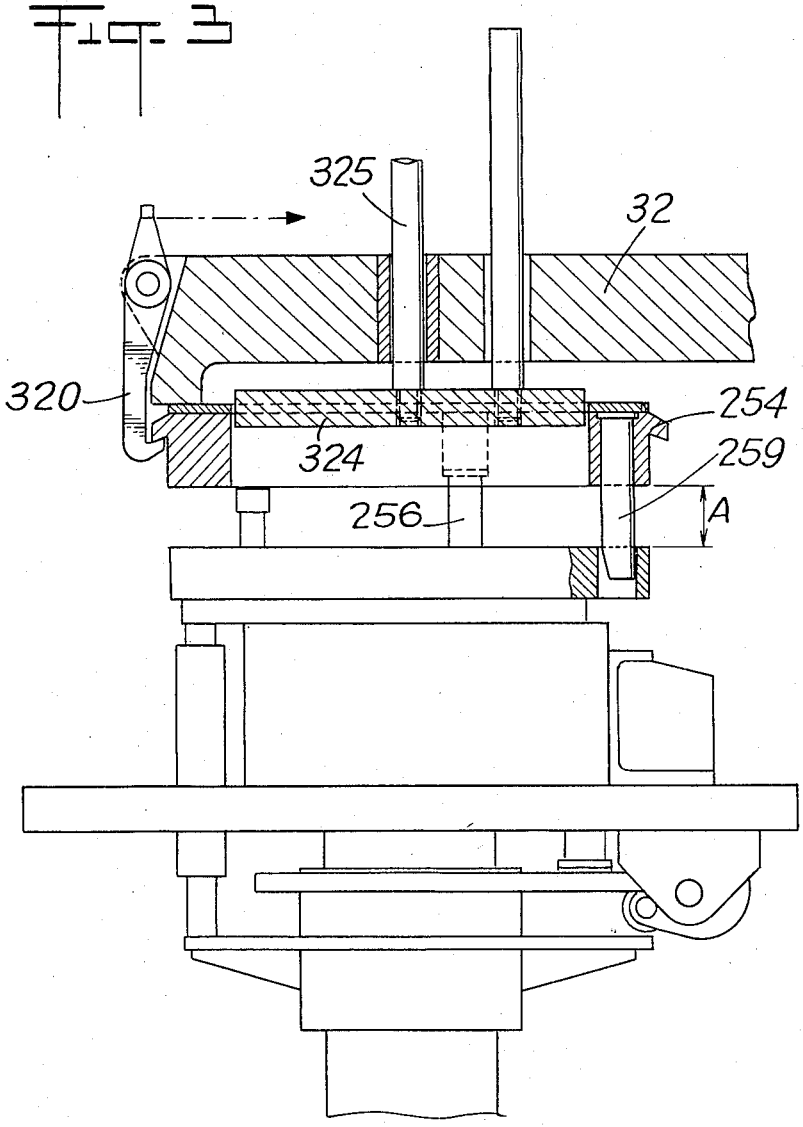

FIG. 3 illustrates the raising up of the frame 254 (A) by means of the first rod 318 of the jack 317. Said partial raising permits to release the locking means provided for closing the mold and consisting in elements 259 and thus to relieve the jack 27 actuating the plate 26.

Figure 4:
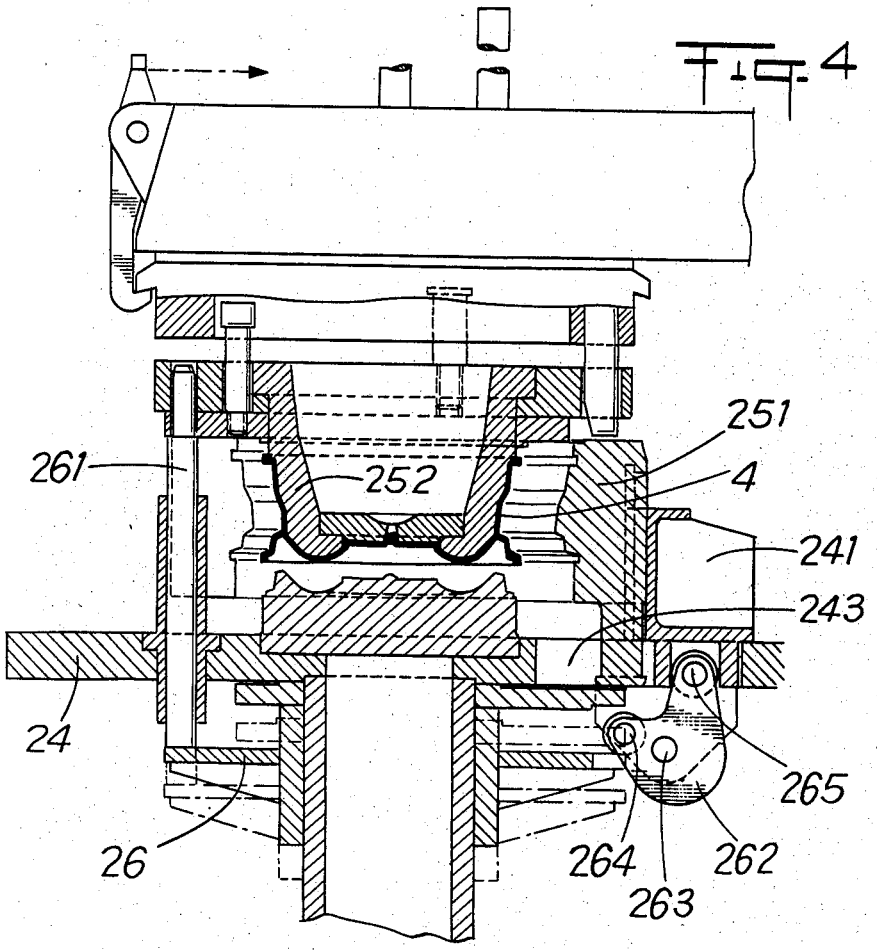

FIG. 4 illustrates the end of the following operation for stripping the casting, i.e. the opening of the mold by raising the plate 26 controlled by the jack 27. During this raising operation, the spindles 261 lift the upper part 252 of the mold, the stripping plate and the casting 4 which remains adherent to the part 252. At the same time, the plate 26 lifts the lateral parts 251 of the mold and causes the lever 262 to pivot, said lever ensuring the radial movement of the said parts. It is to be noted during this operation, that the movement between the casting 4 (or the part 252) and the parts 251 is essentially radial, this permitting to avoid any jammings. It is also recalled that the parts 251 can be raised due to their connection for vertical sliding on their respective shoe 241.

Figure 4A:
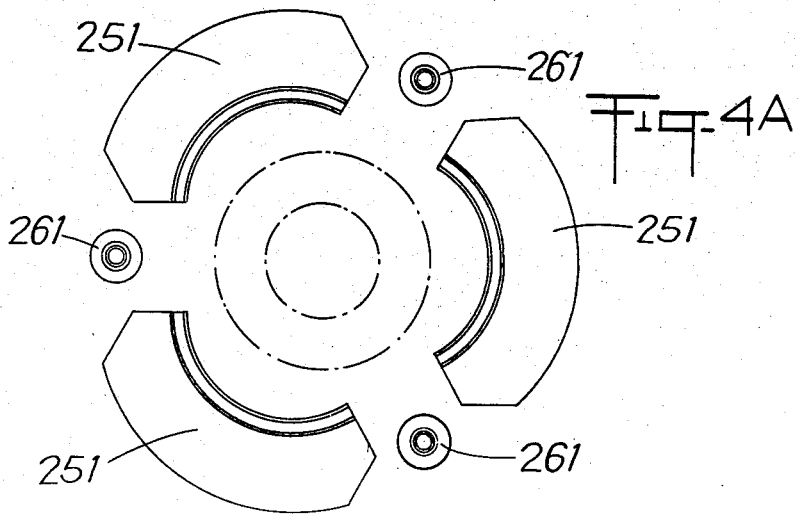

FIG. 4A illustrates with a partial plan view the shape of the lateral parts 251 of the mold and their relative disposition with respect to the spindles 261 (in the position shown in FIG. 4).

Figure 5:
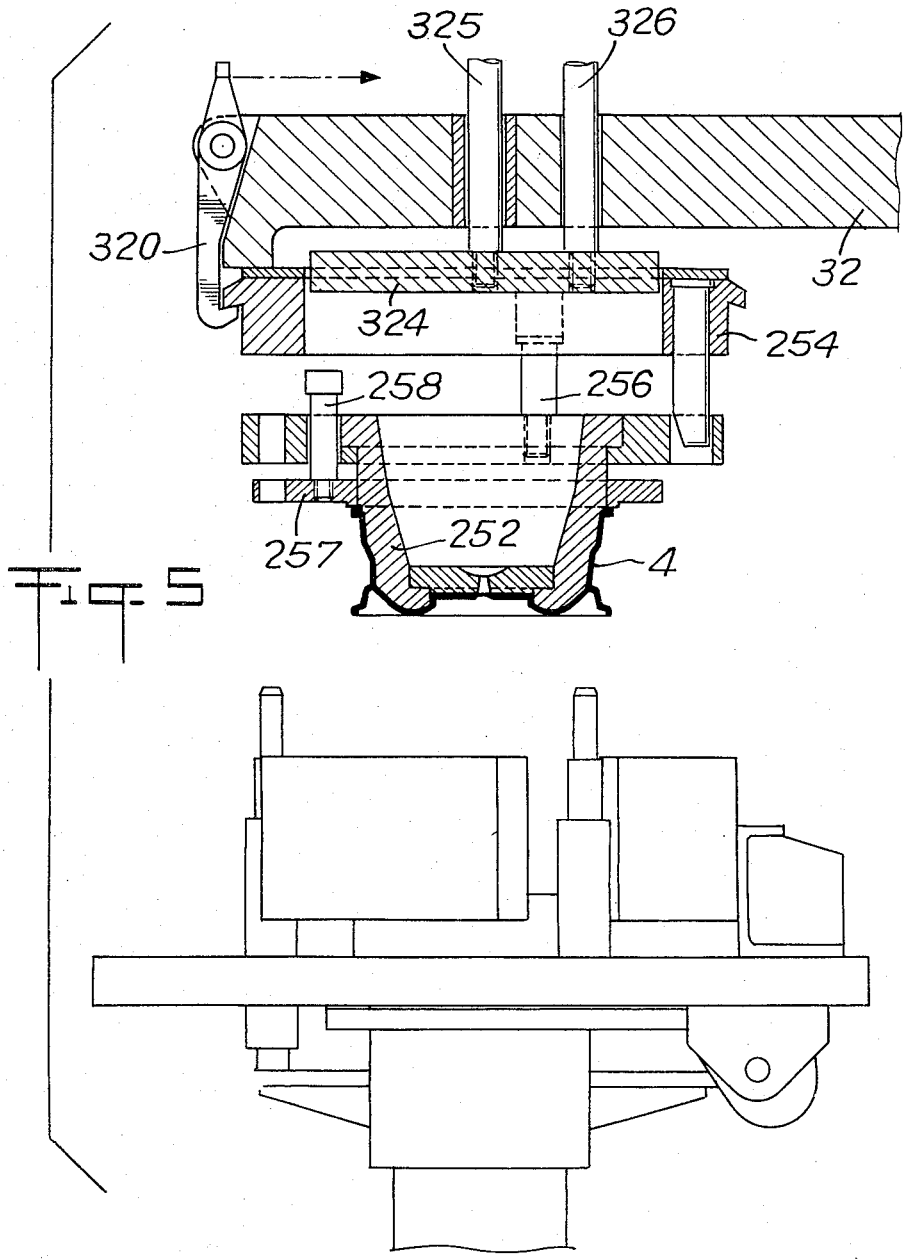

FIG. 5 illustrates the end of the operation for raising the top part of the mold. After opening of the mold (FIG. 4), the rod 319 of the jack 317 is pulled out, thereby entailing the lifting of the shaft 311 and of the arm 32. It is seen that the upper part 252 of the mold which carries the casting 4 is hanging to the frame 254 by the tie-bolts 256. During this final raising stage, the stripping plate 257 has slid downwards to come into abutment on the casting 4, its tie-bolts projecting upwards from the part 252.

The jack 315 is thereafter fed in order to cause the rotation of the shaft 311 over 90, 120 or 180°, depending on the situation of the working position, to bring the part 252 of the mold above the position where the casting is released. After such rotation of the bracket, the shaft 311, and therefore the arm 32, are brought down via the jack 317 to the level of the release position, and the jack 325 is actuated to push the ejector plate 324 downwards, and, by resting on the tie-bolts 258, to detach, by the plate 257, the casting 4 from the part 252.

On completion of that stage in the cycle which corresponds to the stripping of the casting, the ejector plate is lifted back (jack 325) as well as the bracket (jack 317 of the two rods 318 and 319), the said bracket is rotated (jack 315) to bring the part 252 straight above the rest of the mold (parts 250 and 251). At the same time, the plate 26 will have been lifted down (jack 27), thus bringing down the lateral parts 251 and bringing them closer to the shoe 250. The bracket is then brought down (jack 317) to close the mold. The claws 320 are thereafter loosened (jack 322) and the bracket is lifted back up and released by rotation. The mold is thus ready for the next casting which is carried out at the same time as, with the motor 23, the angular element 22 and the shaft 21, the whole assembled unit is pivoted on the plate 24.

The invention finds an interesting application in foundry works.

What is claimed is:

1. Centrifugal casting machine for producing castings in light alloy, and in particular vehicle wheels, comprising a mold made up of several parts integral with a support pivoting about a vertical axis, means for closing and opening the mold and means for stripping the casting, wherein the said mold is composed of a base plate integral with the said support, of lateral parts and of an upper part provided, in the vertical axis of the support, with a mold supplying orifice, the said opening and closing means are constituted by a plate, which is movable vertically along the pivoting support, and comprising pins for lifting the said upper part, being supported under a lower face of the latter, and a connecting rod assembly connecting the said lateral parts to the said plate so as to drive the latter radially when the plate moves axially, whereas the said stripping means are constituted by a bracket formed by a vertical post and by a horizontal arm rotatably and vertically movable with respect to the post, said arm being equipped with means for gripping the upper part of the mold and for stripping the casting.

2. The casting machine of claim 1, wherein each lateral part of the mold is coupled, for vertical sliding, with an outer shoe for radial driving, which is adapted to slide radially on the pivoting support and comprises a lower part extending through the said support on which lower part, the plate which is mounted for vertical movement along the support, can rest during its vertical movement for raising the said lateral wall at the time as the upper part of the mold.

3. The casting machine of claim 1, wherein said connecting rod assembly consists of a radial lever bent at an angle of about 90°, pivotally mounted by its top end on the said pivoting support, one of its other ends being engaged between two horizontal faces of the said vertically movable plate, whereas the other end is engaged between two vertical faces of the said shoe.

4. The casting machine of claim 1, wherein the upper part of the said mold comprises an upper frame provided with an external gripping ring, which frame is coupled to the rest of the said upper part by means which permit a vertical movement of the frame, with respect to the said part of the mold and above it, of a predetermined amplitude.

5. The casting machine of claim 4, wherein the horizontal arm of the bracket is integral with a vertical column mounted for rotation and translation in a vertical support parallel to the aforesaid pivoting support, the said arm being provided with hinged claws adapted to cooperate with the gripping ring of the said frame, under the effect of a member for controlling the pivoting movement of the said claws.

6. The casting machine of claim 1, wherein the upper part of the said mold comprises a stripping plate placed under the lower face of the said upper part and coupled thereto by means which permit a relative vertical movement of the said plate, beneath the said surface, of a predetermined amplitude, when said means are actuated by an ejector device.

7. The casting machine of claim 6, wherein the horizontal arm of the bracket is integral with a vertical column mounted for rotation and translation in a vertical support parallel to the aforesaid pivoting support, the said arm being provided with an ejection plate coupled with a member for controlling its vertical movement under the said arm, and adapted to cooperate inside the frame with the coupling means of the stripping plate.

8. The casting machine of claim 5, wherein the means for controlling the vertical movement of the shaft are placed between the said shaft and a rotating but immobilized-in-rotation part of said support and are arranged on two levels so as to create a first arm raising movement of amplitude corresponding to the predetermined amplitude of the relative movement of the frame and of the upper part of the mold, and a second vertical movement for raising higher the upper part of the mold and of the casting to allow the release of the latter from the other parts of the mold by rotation of the shaft.

9. The casting machine of claim 8, wherein the means for controlling the rotation of the shaft are constituted by a pinion fast in rotation with said shaft but fixed in translation, and by a rack cooperating with the said pinion and controlled in a back and forth movement.

10. The casting machine of claim 1, wherein the driving means for controlling the raising of the said movable plate, the raising and rotation of the said shaft, the pivoting of the claws and the lowering of the ejector plate are hydraulic jacks.

* * * * *

UNITED STATES PATENT AND TRADEMARK OFFICE

CERTIFICATE OF CORRECTION

PATENT NO. : 4,281,707

DATED : August 4, 1981

INVENTOR(S) : Jean Leleu

It is certified that error appears in the above-identified patent and that said Letters Patent are hereby corrected as shown below:

Column 5, line 37, before "time" insert -- same --.

Signed and Sealed this

*Third* Day of *November 1981*

[SEAL]

*Attest:*

GERALD J. MOSSINGHOFF

*Attesting Officer* *Commissioner of Patents and Trademarks*